United States Patent [19]

Swallow

[11] Patent Number: 4,850,309

[45] Date of Patent: Jul. 25, 1989

[54] BOILER HYDRAULIC COLUMN CHOKE AND REAMER WITH BURNER CONTROL PROTECTION AGAINST A LOW WATER CONDITION

[76] Inventor: David H. Swallow, P.O. Box 1381, Havre, Mont. 58501

[21] Appl. No.: 244,007

[22] Filed: Sep. 14, 1988

[51] Int. Cl.[4] ..... F22B 37/18; F22B 37/48

[52] U.S. Cl. ..... 122/379; 15/104.05; 15/104.1 R; 15/104.16

[58] Field of Search ..... 122/379, 391; 15/104.05, 104.1 R, 104.16; 137/318

[56] References Cited

U.S. PATENT DOCUMENTS 4,488,515 12/1984 Swallow ..... 122/379

4,545,308 10/1985 Zaterka ..... 122/379

*Primary Examiner*—Edward G. Favors

*Attorney, Agent, or Firm*—J. Gibson Semmes

[57] ABSTRACT

An improved hydraulic column choke valve and reamer, adapted to hot water heating boilers and the like, permitting maintenance on low water fuel cut-off controls and similar columns without draining the boiler, characterized by a universal valve body and locking mechanism which interchangeably mounts a reaming assembly and/or choke assembly, the latter of which may be retained in the column after removal of the valve body. The water column choke is adapted to columns of variant horizontal cross-section without exchange of the valve body, per se. Supplemental to the basic choke valve is the adaptation of an electric low water cut-off control, useful as and when the water column may be isolated from the boiler.

4 Claims, 5 Drawing Sheets

BOILER HYDRAULIC COLUMN CHOKE AND REAMER WITH BURNER CONTROL PROTECTION AGAINST A LOW WATER CONDITION

BACKGROUND OF THE INVENTION

The invention is related to the prior tool developments of DAVID H. SWALLOW, Pat. No. 4,488,515, dated Dec. 18, 1984. The invention comprises substantial improvements thereover, wherein the choke, the reamer, locking mechanism, packing components and criticality of materials therefor are highlighted. It is specifically useful as a combination boiler tool in isolating, testing by slow drain and repairing. It isolates only one safety control at a time. Within the device described hereinafter the choke comprising an expandable-contractable element being subject to recall, after having been compressed for long periods of time, includes an associated adjusting nut which may be spun back considerably more than was heretofore possible. By applying pressure between the invention compression rod knob of the hydraulic column choke and its compression rod sleeve knob, the rubber compression component thereof may accordingly be extended in length. The net effect will be to reduce the outer diameter of the rubber component less than its original or normal diameter, thereby entirely eliminating the possibility that a major portion of the expandible choke will remain expanded and thus become stuck inside the boiler or column piping. Likewise, this first improvement provides a better water seal in place, as the expandible choke component can not pull away from the end of its compression rod sleeve and return cone, if the associated take-up nut be accidentally unscrewed too far as it could in the invention of Pat. No. 4,488,515.

The new packing compression ring of the improved invention moreover now effectively contains a substantial part of the unit's locking mechanism. Thus, the improved locking mechanism now permits locking of its compression rod sleeve at any given point along the length thereof. In the invention of Pat. No. 4,488,515 this distance was heretofore limited to the length of extension bolts which were welded on each side of the unit's main housing. A new safety lock collar herein, likewise provides a positioning screw to prevent the collar from rotating on the safety lock when setting the locking screw. This, then prevents accidental screwing of the locking screw into one of the three slots which are cut parallel to the axis of the screw into the outer end of the safety lock, the purpose of the newly formed slots being to allow the outer end of the safety lock to move inward, compressing against the compression rod sleeve, thereby creating a locking effect when its setscrew may be securely screwed in tight. Not only does the improved locking mechanism greatly simplify the use of the tool and establish speed in locking same, it also eliminates the use of extraneous flat plates, locking nuts, etc., which heretofore required extra time in threading on and off, the socket, t-wrench and long threaded extensions. The new apparatus furthermore permits locking at any predetermined position in which the compression rod sleeve or reamer rod may be set; likewise it is common to either hereinafter defined ISO-TEST/choke or PRO-CHECK/reamer units.

Further advantages through improvements to the reamer may be stated as follows. In the improvement, both reamer and its return cone are unitary in construction. Extensions have been added to the rods permit use of the assembled unit in areas wherein space may be restricted, as for example underneath a boiler's breaching or by reason of related equipment restricting the available working space available. These rods and their extensions are disposed in sealed relation to a main body common, hereinafter described. In this first improvement, a new locking mechanism permits locking the reamer shaft/rod in position when adding or removing such an extension. Thus, if there is pressure inside the vessel or piping, it could otherwise rapidly force the length of working rod that may already be set inside the piping outward.

A second improvement to the basic concept comprises a given boiler with burner control protection against a low water condition, while the water column may be isolated from the boilers. This is especially useful in single control boilers, where no back-up protection may be available. Thus with the addition of an electric probe to the head of one invention test tool, used in the upper water column leg on hotwater heating boilers, this control will serve not only as the primary control when in use on single control boilers, but also as a secondary control on dual control boilers. This way a given boiler will always be protected, if the device of the second improvement is used properly. This second improvement applies only to the unit which is set into the upper leg on a given water column. The lower leg may still use the regular improved unit tool. The electric circuit herein may be tied into the conventional low water cut-off circuit by incorporating therein a normally closed lock out switch for this function. When the improved probe control circuits are plugged in, the normal circuit is thereafter opened, current then flowing through the present additional control circuit and back into the conventional circuit to the burner. This method places all the low water controls in series and thus any single control can shut down the burner.

SUMMARY OF THE INVENTION

Improvements to U.S. Pat. No. 4,488,515 dated Dec. 18, 1984 are herein described, the same to include for hot water and steam boilers coactive apparatus for preventive maintenance and repair, known as isolating boiler safety controls, testing by slow drain and otherwise avoiding unscheduled boiler shut-downs, heretofore required to determine condition of safety controls and/or progression of scale build-up, all without isolation of both conventional controls. The invention is especially useful in determining progression of scale build-up in problematic boiler zones which are known as raw water make-up lines. A secondary feature of invention is associated with the input circuit to a conventional burner control and may be identified as an adjunct to the compression rod choke assembly to serve as a probe type low water burner cut-off.

DESCRIPTION OF THE PREFERRED EMBODIMENTS

Figure 1:
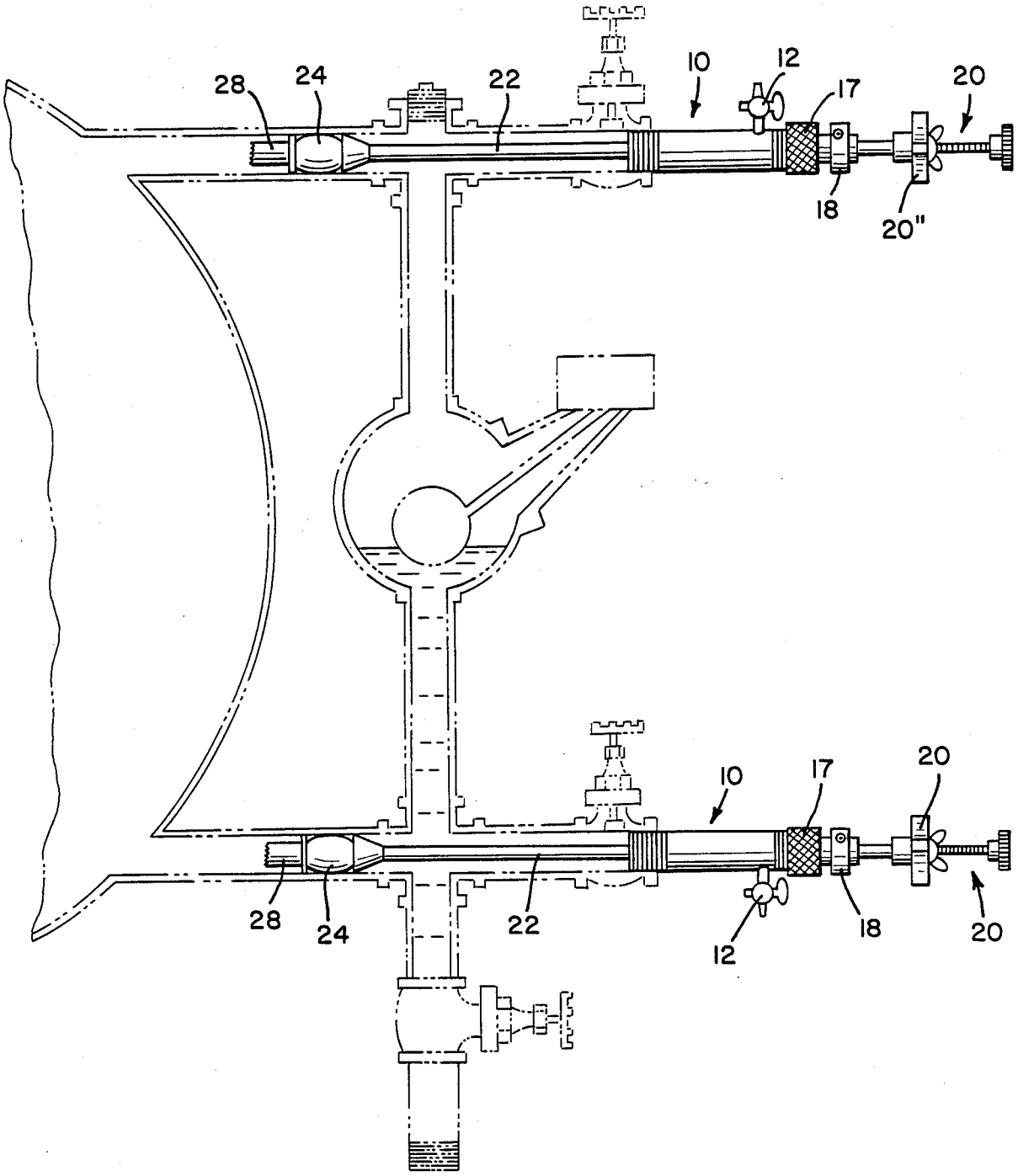
FIG. 1 is a view in side elevation, depicting two invention chokes in two related isolate test positions, the elements of a boiler under test being depicted in vertical sectional phantom.
Figure 2:
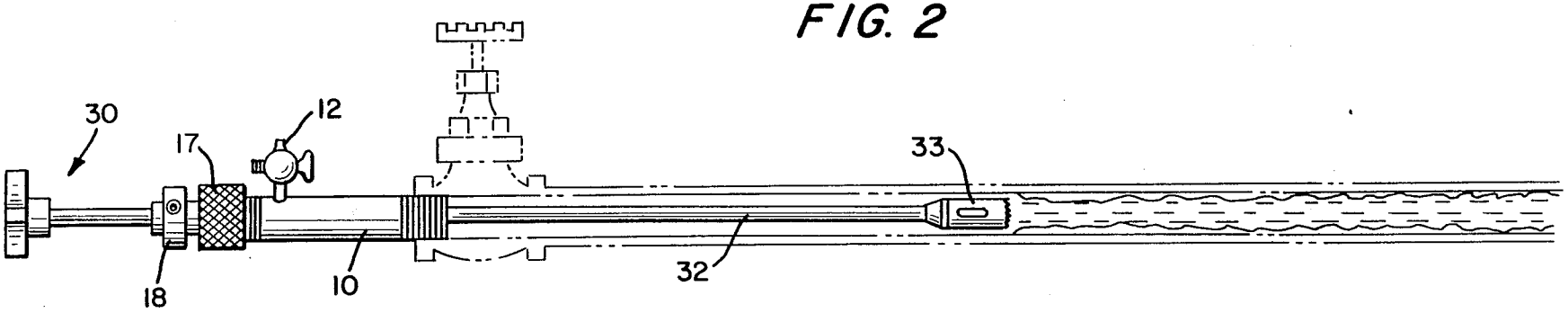
FIG. 2 is a view in side elevation of an alternate invention reamer as applied to a raw water make-up line having scale build-up, wherein the line is illustrated in vertical sectional phantom.

The boiler tool of the present invention is adapted not only to isolate safety controls but also to test slow drain and ultimately to repair components of boilers, especially in preventive maintenance. The boiler tool is best depicted in FIG. 1 showing its horizontal dispositions relative to boiler water column lines as well as a control valve, interposed therebetween. The respective tools are shown in the isolate function at the top of FIG. 1 and in the testing function by slow drain in the lowermost side elevation view. Referring to FIG. 2, the tool is shown in horizontal adaptation to a raw water make-up line wherein the tool not only will check but also ream as against the progression of scale build-up in problematic areas. The use of the tool in the form shown in FIG. 1 is identified as ISO-TEST tool usage and the usage of the tool in the FIG. 2 configuration is known as descaling PRO-CHECK tool, with extension in sealed relation to the main body and piping.

Figure 3:
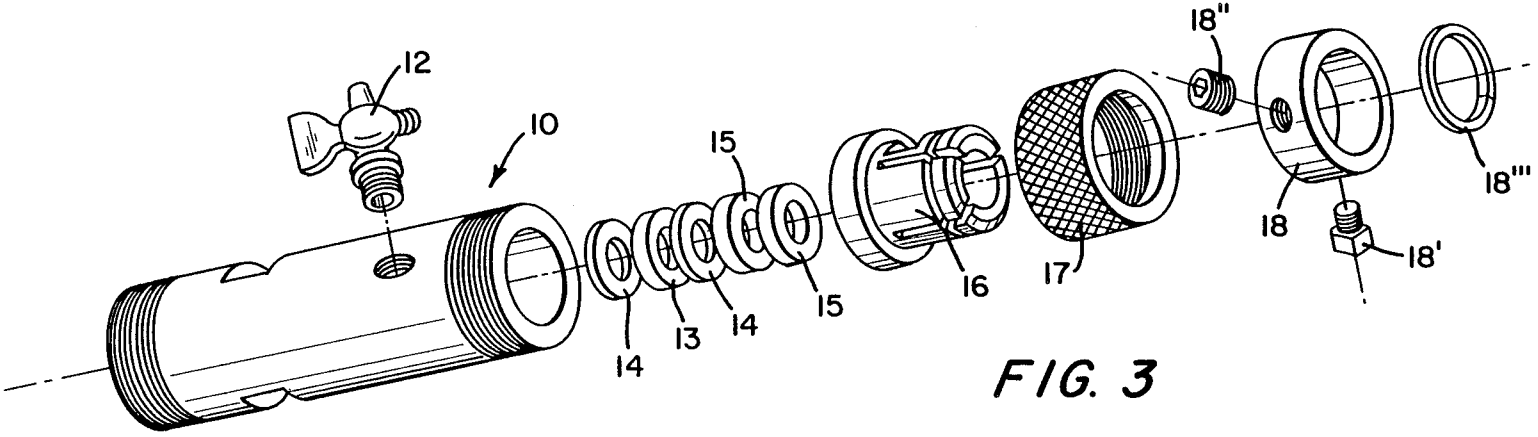
FIG. 3 is an isometric exploded view of the ma&n body depicted in FIG. 1, the relevant main body, common to both the choke and reamer, being shown in FIGS. 3A and 3B.
Figure 3A:
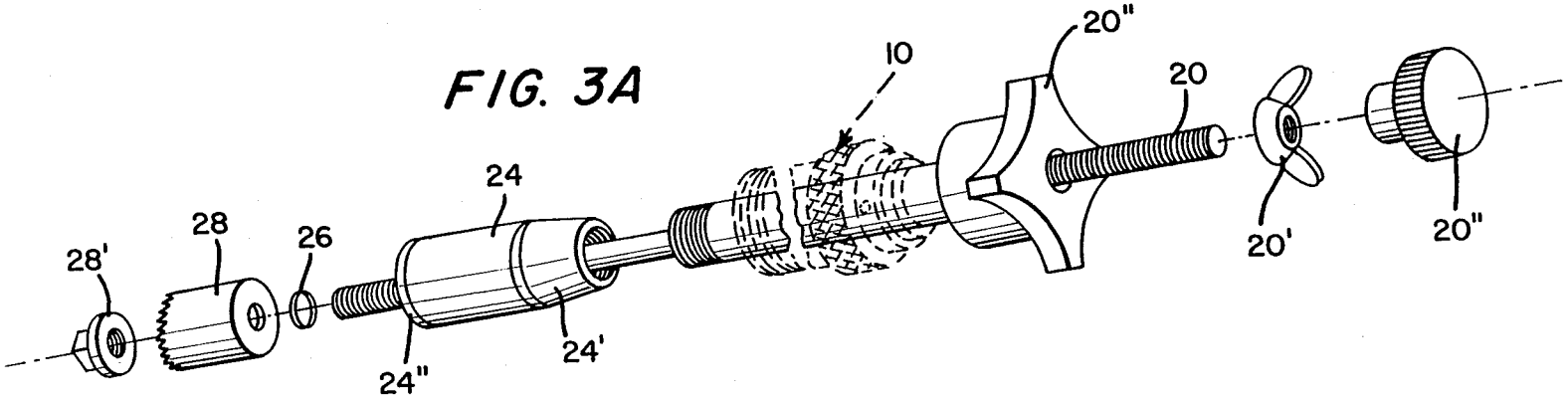
FIG. 3A is an isometric exploded view of the invention choke assembly, less the main body of FIG. 3 which is applied thereto in common with the reamer of FIG. 3B.
Figure 3B:
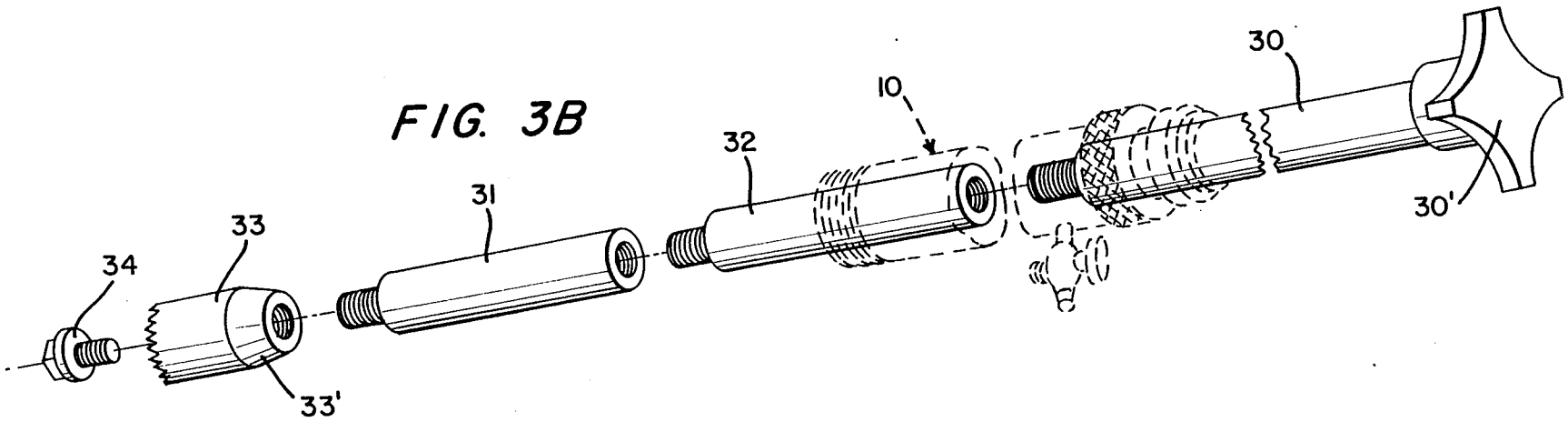
FIG. 3B is an isometric exploded view of the invention reamer assembly, less the main body of FIG. 3A which is applied thereto in common with the choke of FIG. 3.

The details of the respective alternately adaptable tools are best shown by reference to FIGS. 3, 3A and 3B wherein the components are shown in exploded view, relative to each other. For example, FIG. 3 depicts in order left to right, the main housing 10 which is adapted to secure the vent and drain valve 12 thereto. See the functioning of the valve in the lowermost showing of the tool in FIG. 1. The main housing is adapted to contain shaft seal 13 between seal retainers 14, in line with two packing washers 15. Further in line is the safety lock packing gland compression ring 16, the elements 14–16 inclusive being forceably secured within the main housing by the packing nut 17. Regarding the safety lock packing gland compression ring 16, it will be noted that the right hand portion thereof contains a groove or flat void on its top to screw positioning screw 18'' into and a groove around its circumference for the retaining/snap ring 18'''. Retaining/snap ring 18''' prevents safety lock collar 18 from sliding off the right hand end of safety lock packing gland compression ring 16.

This locking mechanism which comprises safety lock packing gland compression ring 16, safety lock collar 18, locking screw 18' and positioning screw 18'' permits locking of the compression rod sleeve hereinafter defined as element 22. The new safety lock collar formed by these elements has a positioning screw 18'' which prevents the collar from rotating when setting the locking screw 18'. This, furthermore prevents accidental screwing of the locking screw 18' into one of the three slots which have been cut in the outer end of the safety look packing gland compression ring 16, the purpose of the slots being to permit the outer end of safety lock packing gland ring 16 to move inward, thereby compressing against the compression rod sleeve 22 which would cause a locking effect when the locking screw 18' is securely screwed in tight. This locking mechanism simplifies use of the tool and speed in locking; moreover the arrangement eliminates the use of flat plates, locking nuts and the like which heretofore required extra time in threading on and off, socket, T wrench and long threaded extensions in U.S. Pat. No. 4,488,515. The new mechanism hereinabove described allows locking at any shiftable position wherein the compression rod sleeve 22 or reamer rod may be set. Moreover, this arrangement is common to either the FIG. 3A choke Or FIG. 3B reamer unit. Noteworthy is the fact that the rods 22, 30, 31 and 32 hereinafter defined as useful for the reamer PRO-CHECK are all of common outside diameter. To complement the construction of the main body common, the assemblage includes locking screw 18', positioning screw 18'', and collar retaining ring 18''' interpositioned, relative to the packing nut 17 and forming thereby the safety lock collar 18.

Referring now to FIG. 3A the ISO-TEST unit previously depicted in FIGS. 1 and 3 is shown, less the main body common of FIG. 3. By reference to FIGS. 1 and 2, it will be apparent that the main body common, its associated housing 10, valve 12 and locking screw 18' will be disposed substantially concentrically relative to the compression rod sleeve and knob 22, reference the FIG. 3A construction. This construction comprises compression rod 20 with associated adjusting V-plug or take up nut 20' and compression rod knob 20'' at its right end. The compression rod sleeve and knob 22'' are depicted in position relative to the V-plug assembly 24. This V-plug assembly includes three parts, vulcanized together, namely, the elements 24-24'-24'' inclusive, namely V-plug 24, threaded cone 24' and nut washer 24''. Terminating the operative end of the device is the lock nut 28' and reamer 28. In operation, should the expandible V-plug assembly 24 of the choke be slow to recall, after expandible compressing for long periods of time, the associated adjusting nut 20' may be further spun back and by applying pressure between the invention compression rod knob 20'' and compression rod sleeve knob as a part of the compression rod sleeve 22, the expandible rubber component may accordingly be stretched and extended in length. The effect will be to reduce the outer diameter of the expandible-contractible rubber component, less than its original or normal diameter. Thus entirely eliminates the possibility of the expandible-contractible rubber material remaining expanded and becoming stuck inside the boiler or column piping thereof. Moreover, the FIG. 3A arrangement of parts 20–28' inclusive provides not only a better water seal but avoids the possibility that the sealing component, namely V-plug assembly 24 may pull away from the end of the compression rod sleeve 22 and return cone 24', should the take-up nut 20' be accidentally unscrewed too far.

Referring to the inter-relation between the FIG. 3 main body common and the associated configuration of FIG. 3A, the improved locking mechanism comprising packing gland/compression ring 16, collar 18, locking screw 18' and positioning screw 18'' permits locking of the main housing 10 at any point along the length of compression rod sleeve 22. See for example FIG. 1. Within this FIG. 3 construction, the safety lock collar has a positioning screw 18'' to prevent the collar 18 from rotating on the safety lock packing gland/compression ring 16 when the locking screw 18' is being set, thus preventing accidentally screwing of the locking screw 18' into one of the three slots which have been cut into the outer end of the safety lock compression ring or gland 16. The purpose of the axially aligned slots is to permit the outer end of the safety lock packing gland ring 16 to constrict radially inward, compressing against the compression rod sleeve 22, thereby causing a locking effect when the set screw 18' is securely screwed in tight. Ring 18''' is a snap ring which sets into a circular groove of the packing gland compression ring 16. It retains collar 18 against sliding on gland 16. This construction eliminates the requirement for flat plates, locking nut and the like, all of which require extra time in threading on and off; moreover the new construction permits locking onto the sleeve in any position wherein the compression rod sleeve and/or reamer rod may be set. Thus, the main body parts of FIG. 3 are effectively common to each of the modifications of FIGS. 3A and 3B, especially inasmuch as the relative diameters of comparable parts in the FIG. 3A and 3B constructions are of the same outside diameter.

Referring to the PRO-CHECK construction of FIG. 3B it will be noted that the reamer and return cone are of unitary shortened construction, relative to the prior art. The cone portion of the reamer 33 is threaded and screws on to the end of the reamer-head adaptor rod 31 and is locked on by the reamer-head lock nut 34. Element 30 includes the PRO-CHECK control rod and knob. Here it will be noted that the extensions 31 and 32 are included to permit using the unit in areas where space may be restricted as for example beneath a boiler's breaching, etc. Whereas detents or snap locks may be used to join the components together, coactive threading is preferred. Preferably the interconnection between extension rod 32 and the reamer-head adaptor rod 31 is now threaded. While not shown, an closed slip clutch having a clockwise torque permits the handle 30' to turn freely counterclockwise without turning of the reamer-rod itself which would unscrew the connection 30–31'. This slip clutch is preferably a part of the PRO-CHECK control knob 30 and may be further defined as a pawl-ratchet knob of clockwise engaging turn. When the knob 30' is turned counter-clockwise it has a slip clutch effect, turning freely without rotating integral rod 30 or the adapter rod and/or extension 31–32.

Figure 4:
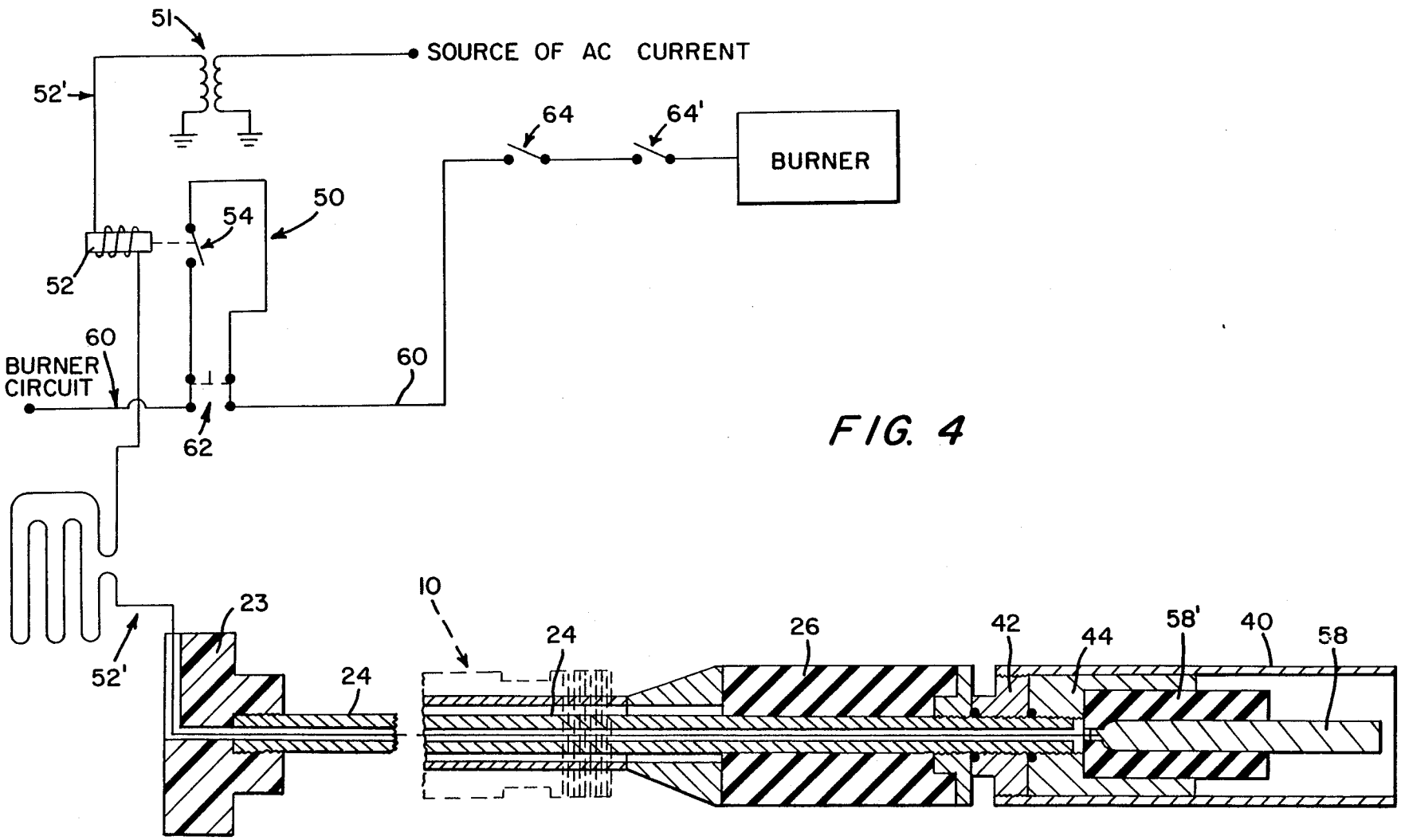
FIG. 4 is an elevational view of an electric probe type low-water cut-off control as adapted to a modified invention choke of the type depicted in FIGS. 1–3 inclusive.

Referring to FIG. 4, means are shown providing the boiler with protection against a low water condition while the water column may be isolated from the boiler, especially as in a single control boiler Where no back-up protection may be available. This invention includes the addition of the electric probe to the head of one such tool as depicted in FIG. 3A wherein said probe is used in the upper water column leg on hot water heating boilers. Likewise this control will serve as the primary control when used in the functioning of single control boilers and as a secondary control on dual control boilers. Thus a boiler may always be protected if this FIG. 4 innovation is properly used.

Figure 4A:
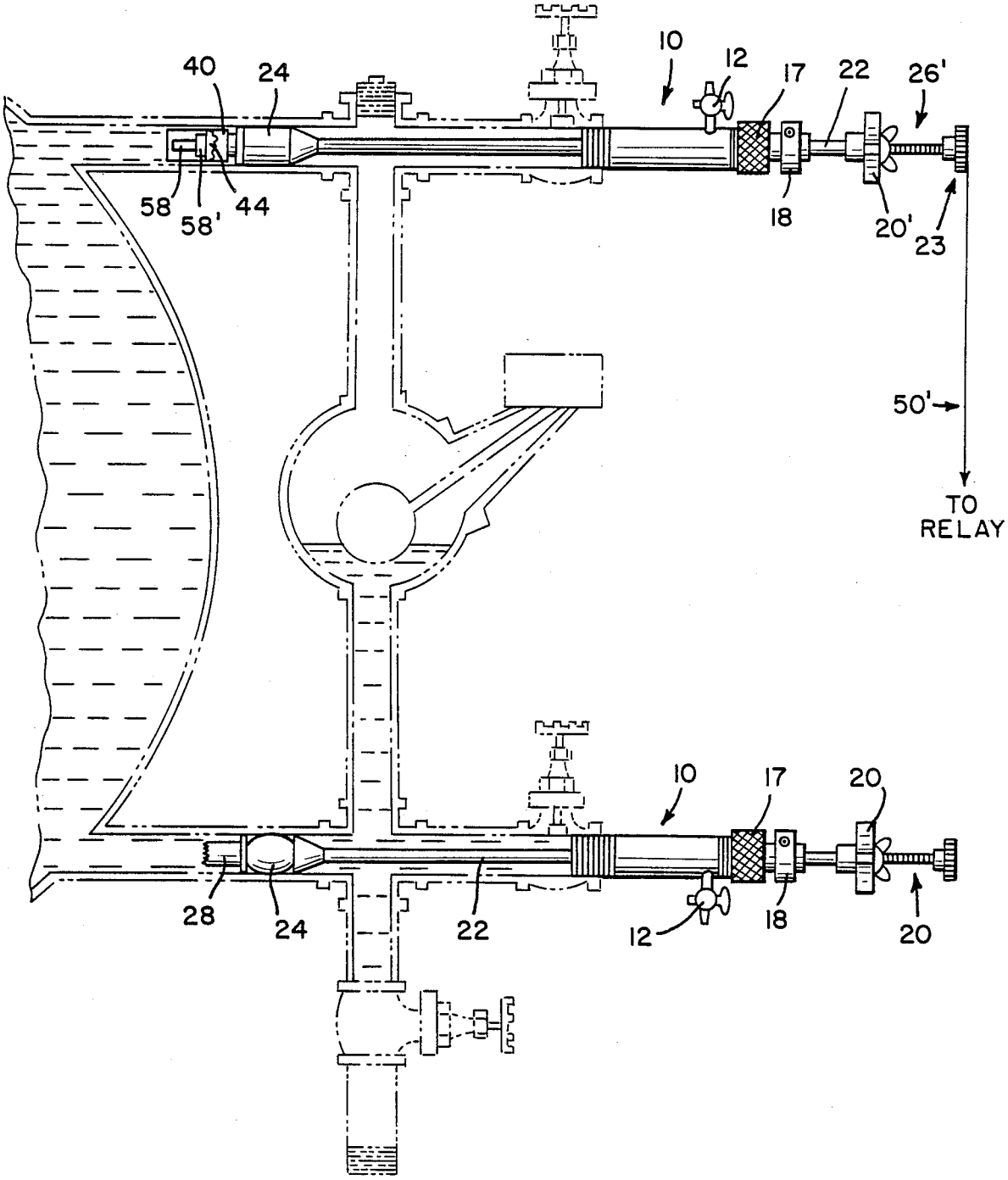
FIG. 4A is an enlarged view in side elevation, depicting an electric probe type cut-off control-choke unit in the upper horizontal leg a of the water column, which is shown in phantom.

The probe type cut-off in FIGS. 4 and 4A shows adaptation to a similar but hollow compression rod 24 of the probe tool. The shield 40 is to protect the probe from damage if bumped and replaces the reamer head for the tool unit to which it is applied. The shield thus has two coaxial parts 40–42 to permit tightening the control down against the threaded shield plate 42. The shield may then be placed over the control probe 58 and screwed onto its plate 42 whereon it is sealed by means of o-rings as against a metal head 44 of the probe. This improvement applies only to the unit inserted in the upper leg on the boiler column when low water cut-off protection is desired, it should be noted. The lengths of the main body, compression rod and compression rod sleeve will clearly be extended herein proportionately, to compensate for any extra length or lengths caused by the addition of the control in question. Thus, the compression rod 24 is also made of hollow tubing with heavy enough wall thickness for threading and yet a large enough internal diameter to contain the control wire. When the water level drops below probe 58, there is no longer any water to complete the circuit. Without current to hold in the low voltage relay 52, the normally open switch or contact 54 will open and the burner will shut off as long as circuit 50 is plugged into the burners normal circuit 60 by means of the normally closed lock-out switch 62. The circuit 50 may be connected to the regular low water cut-off circuit 60 by incorporating a normally closed lock-out switch 62. It is notable that the boiler herein must be grounded. That is to say, the input circuit to the burner control must be grounded. The circuit 50 may be connected to the regular low water cut-off circuit 60 by incorporating a normally closed lock-out switch 62. Within the regular cut-off circuit are shown first and second low water cut-off series switches 64 and 64'. These function to open when the undesired low water condition exists in the boiler. See FIG. 4A. When the probe control circuit 50 is plugged in, the normal circuit 60 is open and current then flows through the additional control circuit and back into the normal circuit to the burner. This places all the low water controls in series and any single control may shut down the burner.

Key elements in the probe control circuit include from the power source, low voltage or step down transformer 51, low voltage relay coil 52, dielectric knob 23, and the probe 58 itself. The knob is provided with appropriate channels into and out of it in a coaxial arrangement relative to the compression rod 24, all passing through the center of the V-plug 26, through the shield sleeve 40 and its associated threaded shield plate. The conductor of the low voltage circuit 52' likewise passes through metal head 44 which contains an insulator 58' for the metallic probe 58.

I claim:

1. In combination with an hydraulic vessel having boiler water supply and cut-off control, wherein the upper and lower legs of a hydraulic vessel's water column include full opening valves as permanent fixtures, these being outside the circulating path of the water column and normally plugged when either maintenance or testing function is not being exercised, the improvement of an hydraulic column choke and alternately operative reamer comprising:

(A) a tubular main valve body common which is compression engagable with the column of an hydraulic vessel, said main body common mounting a valve-controlled vent and drain therein;

(B) a slideable compression rod and exterior sleeve therefor mounted in the main valve body common, a working end of the compression rod and sleeve securing (C) a flexible column choke vulcanized to rigid open threaded ends thereof, the choke being secured to the compression rod and sleeve in sealed relation to the main body common;

(D) a slideable safety lock, including a packing gland compression ring and lockable collar therefor, mounted around the compression rod sleeve or alternate reamer rod, the lock being moveably connected to the main body common, whereby to lock the main body relative to the compression rod sleeve or reamer rod at any preselected position along the length of the reamer rod or sleeve and its associated compression rod.

2. The combination according to claim 1 further comprising:

(E) a reaming assembly, reciprocably and rotatably mounted in coextension of the choke and in sealed relation to the main body, the reamer assembly defining an inner end, with at least one coaxial channel therein and a compressive packing gland in said reaming assembly, whereby to seal the assembly relative to the choke and main body.

3. The combination according to claim 1, further comprising:

(E) a reaming assembly, reciprocably and rotatably mounted in sealed relation to the main body, said reaming assembly including a pawl-ratchet knob and connected reamer at opposed ends of reamer rods, the reamer defining an inner end with at least one coaxial channel therein and a compressive packing gland in said reaming assembly, whereby to seal the assembly relative to the main body.

4. The combination according to claim 1, further including an electric low water cut-off probe which is connectible to the compression rod of the flexible column choke and electric circuit means interconnecting the probe and conventional boiler low water cut-off control circuit.

* * * * *